US007160174B2

(12) United States Patent
Kiontke et al.

(10) Patent No.: US 7,160,174 B2
(45) Date of Patent: Jan. 9, 2007

(54) METHOD FOR PROCESSING AND MEASURING ROTATIONALLY SYMMETRIC WORKPIECES AS WELL AS GRINDING AND POLISHING TOOL

(75) Inventors: Sven Kiontke, Jena (DE); Alexander Zschaebitz, Jena (DE); Thomas Kurschel, Jena (DE)

(73) Assignee: Asphericon GmbH, Jena (DE)

( * ) Notice: Subject to any disclaimer, the term of this patent is extended or adjusted under 35 U.S.C. 154(b) by 0 days.

(21) Appl. No.: 11/141,959

(22) Filed: Jun. 1, 2005

(65) Prior Publication Data

US 2006/0276107 A1 Dec. 7, 2006

(51) Int. Cl.
*B24B 49/12* (2006.01)

(52) U.S. Cl. ..... 451/8; 451/41; 451/285; 125/13 R; 51/165

(58) Field of Classification Search ..... 451/8, 451/41, 285, 286–290; 125/13 R; 83/71, 83/74, 365
See application file for complete search history.

(56) References Cited

U.S. PATENT DOCUMENTS 4,794,736 A * 1/1989 Fuwa et al. ..... 451/6
5,289,660 A * 3/1994 Terasaki et al. ..... 451/49
5,379,510 A * 1/1995 Berge ..... 29/564
5,532,932 A * 7/1996 Niwa ..... 700/188
5,914,876 A * 6/1999 Hirai ..... 700/87

* cited by examiner

*Primary Examiner*—Lee D. Wilson
*Assistant Examiner*—Anthony Ojini
(74) *Attorney, Agent, or Firm*—Darby & Darby

(57) ABSTRACT

A method for processing a rotationally symmetric workpiece, preferably having optically effective surfaces, whose symmetry axis is aligned parallel with the z-axis and which is moveable parallel with the z-axis, using a rotating, rotationally symmetric grinding or polishing tool whose rotation axis is aligned parallel with the y-axis and which is thereby touching the surface of the workpiece by means of a processing surface, the workpiece rotating around its symmetry axis and to a tool for performing said method as well as a method for tactile measuring of such a workpiece. The invention may be used for processing aspheric workpieces having optically effective surfaces, in particular lenses or mirrors that have a non-processable zone, for example a conical bump in the middle of the workpiece.

15 Claims, 4 Drawing Sheets

METHOD FOR PROCESSING AND MEASURING ROTATIONALLY SYMMETRIC WORKPIECES AS WELL AS GRINDING AND POLISHING TOOL

The invention relates to a method for processing a rotationally symmetric workpiece, in particular for processing a workpiece having optically effective surfaces, whose symmetry axis is aligned parallel with the z-axis and which is moveable parallel with the z-axis, using a rotating, rotationally symmetric grinding or polishing tool whose rotation axis is aligned parallel with the y-axis and which is thereby touching the surface of the workpiece by means of a processing surface, the workpiece rotating around its symmetry axis and to a tool for performing said method as well as a method for tactile measuring of such a workpiece.

The invention is preferably used for processing aspheric workpieces having optically effective surfaces, in particular lenses or mirrors that have a non-processable zone, for example a conical bump in the middle of the workpiece.

BACKGROUND

The production of aspheres is carried out in two steps: initially by grinding or turning in order to create the shape and subsequently by polishing in order to achieve the required surface quality.

In the prior art, both processing steps are performed by means of grinding, polishing or turning machines which are controlled by computer numerical control ("CNC").

In the case of grinding, the tool spindle is aligned horizontally, parallel with the y-axis and at a right angle in relation to the workpiece spindle. The workpiece is affixed onto a support called a spike. The support is clamped into the workpiece spindle. Both tool and workpiece are rotated by means of the spindles. The workpiece can be driven upwards and downwards parallel with the z-axis. The tool can be moved, on one hand, to the front and to the back parallel with the y-axis in order to adjust it to the center of the workpiece and, on the other hand, to the left and to the right parallel to the x-axis in order to perform the processing procedure.

Initially, the grinding tool is a cylindrical grinding disk, where the grinding surface is the cylinder barrel. Diamonds are applied on it in a metal bond or a plastic bond. The grinding disk is formed to a narrow spherical section where the highest or thickest point is located in the midplane of the disk. For an exact processing procedure, it is mandatory always to grind using the highest point of the grinding disk. There is a danger that by wearing down a cavity forms instead of the highest point, both borders of the cavity touching the workpiece. Additionally, the grinding can be impaired by an unbalance of the grinding disk. In order to avoid both said sources of error, the grinding disk is trued after mounting it. For this, a so-called truing stone is glued onto a spike and clamped instead of the workpiece to be grinded. The grinding disk is located exactly perpendicular above the truing stone, the center of its spherical section, i.e., the virtual center of the associated sphere, lying on the elongation of the tool's axis. The grinding disk is then driven along the z-axis into the truing stone very slowly while both truing stone and grinding disk are rotating. By appropriately selecting the hardness of the stone and the rotation speeds both the stone and the disk are worn down. The result is a ball-shaped cavity in the stone and a spherical section shape of the grinding disk. Because of the mechanical and geometrical conditions, the highest point of the grinding disk is located exactly in the rotational center of the truing stone.

The grinding procedure is performed by driving the tool in x-direction across the diameter of the workpiece. During the drive, the desired shape of the workpiece is created by setting the z-position of the workpiece. For this purpose, the path is divided into small line segments for which x-values for the tool and z-values for the workpiece are delivered via a CNC program. The tool's y-position is determined by the truing procedure in a way such that the center of the grinding disk, i.e. its highest point, is running across the rotational center of the workpiece and stays constant during the processing procedure. Thus, the processing can be understood as a radial section through the workpiece, wherein the grinding disk is abstracted as a circle.

For the processing procedure, it is important that the positions of all three axes are defined exactly. The x-axis is adjusted to the greatest possible extent by the manufacturer so that, at an x-value provided by the factory, the axis of the grinding disk is standing above the axis of the workpiece. If this is not the case an error in shape results, from which the false position must be recognized and corrected manually. For this, a sample piece is processed as a general rule. The position of the z-axis must be determined by touching and merely gives the thickness of the workpiece, which can be remeasured directly in general. The position of the y-axis is, similar to the x-axis, adjusted to the greatest possible extent by the manufacturer. However, because the grinding disk is attached in y-direction and tightened a mechanical tolerance always results. Only detaching and re-attaching results in a change of the y-position. If the highest point of the tool is not running across the center of the workpiece exactly, a different point not exactly known is touching the workpiece, whereby an additional error in shape of the workpiece results. The false position with respect to the y-axis is corrected by short retruing.

This known method is not suitable for processing workpieces if an area in the middle of the workpieces, given by the radius of the grinding disk, can not be processed, for example because of unremovable parts in this central area, for example a bump.

For CNC turning, a small plate—the cutting insert—which can be turned around and contains the actual cutting edge, is screwed onto the turning chisel. In order to increase durability of the insert, its edges are chamfered to a round shape. If viewed from above, the radius between the edge running parallel with the rotation axis of the workpiece and the edge running perpendicularly is called cutting edge radius. This is the area of the cutting insert that is directly engaged. For exactly processing it is important to know exactly the cutting edge radius or the deviation from the ideal shape, respectively. In particular when turning cones or more complex shapes as spheres or aspheres, one has to pay attention to the fact that the chisel has to be set in further than would be necessary with a non-chamfered cutting tip because of said radius. Modern CNC turning machines allow entering the cutting edge radius and adjust the CNC program appropriately. It is assumed therein that the radius is kept exactly, i.e. that there is no deviation from the ideal shape.

This procedure reduces the possible accuracy of processing.

For measuring rotationally symmetric bodies, tactile measuring using profilometers is used among other methods. For this purpose, a caliper having a ruby ball or a diamond tip is drawn across the workpiece and the movement of the caliper is calculationally converted to an elevation profile.

After subtracting the specified shape, one obtains the error of the measured object. The caliper normally is a right angle consisting of two sticks, at whose vertical, lower end the ruby ball or the diamond tip is located respectively, and whose vertical stick is suspended in a seesaw. The tilt angle of the seesaw is measured and the position of the measuring ball or tip, respectively, and furthermore the shape of the workpiece are calculated. In the case of rotationally symmetric workpieces, a run across the diameter of the workpiece is performed meanwhile. The z-position of the measuring system is constant in the meantime, it is drawn in one direction only.

This method is not feasible for workpieces having a central bump or hole.

Due to the principle of the method, the absolute position of the workpiece in x-direction is unknown after a tactile measurement. In particular, the measuring system is driven away for each measurement to be able to take out the workpiece so that a constant position of the measuring system is not given across several measurements. One of the aims of analyzing the measurement therefore is to determine the position of the workpiece in relation to the x-axis and, in particular for rotationally symmetric workpieces, to determine the center. One possibility consists in approximately solving a system of equations using the method of least squares.

This implies that the specified shape of the workpiece can be described appropriately analytically. However, this is impossible especially for aspheres.

SUMMARY OF THE INVENTION

An object of the present invention is to specify a method and/or an arrangement by which simple, fast and exact processing and/or measuring of rotationally symmetric workpieces is possible.

The present invention provides a method for processing a rotationally symmetric workpiece, in particular for processing a workpiece having optically effective surfaces, whose symmetry axis is aligned parallel with the z-axis and which is moveable parallel with the z-axis, using a rotating, rotationally symmetric grinding or polishing tool whose rotation axis is aligned parallel with the y-axis and which is moveable parallel with the x-axis and is thereby touching the surface of the workpiece by means of a processing surface, the workpiece rotating around its symmetry axis, characterized in that the tool is moved in exactly one plane that is parallel with the x-z plane and that is distanced from the rotation axis of the workpiece, the tool having a constant y-value.

In addition, the present invention provides a method for processing a rotationally symmetric workpiece, in particular for processing a workpiece having optically effective surfaces, whose symmetry axis is aligned parallel with the z-axis and which is moveable parallel with the z-axis, using a rotating, rotationally symmetric grinding or polishing tool whose rotation axis is aligned parallel with the y-axis and which is thereby touching the surface of the workpiece by means of a processing surface, the workpiece rotating around its symmetry axis, characterized in that the tool, in relation to its point of contact with the workpiece, is moved in exactly one plane that is parallel with the y-z plane and in which the rotation axis of the workpiece is lying, the tool having a constant x-value.

The present invention further provides a method for tactile measuring of a rotationally symmetric workpiece whose symmetry axis is aligned parallel with the z-axis, using a caliper which is moved parallel with the x-axis, the caliper thereby scanning the surface of the workpiece and measuring the z-values of the surface during the course, in particular for acquiring a cutting profile and/or for determining the center of the workpiece, characterized in that the caliper, with regard to its point of contact with the workpiece, is moved in exactly one plane that is parallel with the x-z plane and that is distanced from the rotation axis of the workpiece, the caliper having a constant y-value.

Furthermore, the present invention provides a method for measuring a turning chisel exhibiting a cutting edge, characterized in that a sample piece having piecewise linearly approximated sections which are created by means of the turning chisel is turned instead of a continuous shape of a workpiece to be turned, wherein, respectively, only a certain point of the cutting edge is engaging and a cone segment results, and a planar area of reference is turned onto the sample piece, whereupon the sample piece is measured and, by comparing the positions of the cone segments with the area of reference or by comparing the positions of the cone segments with each other, the position of the respective processing point of the cutting edge is determined as a sampling point of the shape of the cutting edge.

In addition, the present invention provides, a grinding or polishing tool having a symmetry axis and exhibiting a processing surface which is a rotationally symmetric spherical surface section of a virtual sphere whose virtual center is lying on the symmetry axis of the tool, for grinding or polishing rotationally symmetric workpieces, wherein the symmetry axis of the tool is also a rotation axis, characterized in that the processing surface is formed asymmetrically with regard to any mirror plane being normal to the tool's symmetry axis and the virtual center of the sphere is lying outside of the processing surface's midplane in relation to the thickness of the tool, the midplane being perpendicular to the symmetry axis of the tool.

Moreover, the present invention provides a method for producing a grinding tool having a symmetry axis and exhibiting a processing surface which is a rotationally symmetric spherical surface section of a virtual sphere whose virtual center is lying on the symmetry axis of the tool, for grinding rotationally symmetric workpieces, wherein the symmetry axis of the tool is also a rotation axis, by truing a grinding shape, in particular a cylinder shaped one, at a truing stone which is rotating around an axis that is perpendicular to the rotation axis of the tool, characterized in that the processing surface's midplane in relation to the thickness of the tool is offset from the rotation axis of the truing stone during truing.

Further advantageous embodiments are given in the claims.

According to the invention, in a first method the grinding or polishing tool is moved in exactly one plane that is parallel with the x-z plane and that is distanced from the rotation axis of the workpiece, the tool having a constant y-value. Thus, the tool is moved along a chord of the workpiece. In case of workpieces having central non-processable zones this enables to process also the surfaces in the vicinity of the non-processable zones without touching these.

By determining for each x-position of the tool at which y-position the processing surface is going to touch the workpiece first in the case of moving in parallel with the z-axis, and approaching the z-position belonging to said x-y-position the method can be performed simply and with conventional grinding or polishing machines.

In a second method, the tool, in relation to its point of contact with the workpiece, is moved in exactly one plane that is parallel with the y-z plane and in which the rotation axis of the workpiece is lying, the tool having a constant x-value. Thus, the tool is moved radially across the workpiece. Due to the pre-set orientation of the tool, in case of workpieces having central non-processable zones this enables the processing of surfaces in the vicinity of non-processable zones without touching these, because the overlap of tool and workpiece along radial direction is minimized.

According to the invention, a tool is used whose processing surface, being a rotationally symmetric spherical surface section of a virtual sphere whose virtual center is lying on the symmetry axis of the tool, is formed asymmetrically with regard to any mirror plane being normal to the tool's symmetry axis and therefore the virtual center of the sphere is lying outside of the midplane of the processing surface. That way, a steep cross section of the tool can be used for that the processing surface is always perpendicularly overlying the surface to be processed, resulting in low wear, adjustability to the respective shape and optimal processing surface.

If a tool is used that exhibits the shape of a toroid section, the section being made perpendicularly to the symmetry axis, the cross section of the tool can be used for that the processing surface is overlying parallel the surface to be processed. This also results in low wear.

By orienting the tool in such a way that its side that has the steepest slope of the processing surface is pointing away from the rotation axis of the workpiece for concave areas of the workpiece and by orienting it in such a way that its side that has the steepest slope of the processing surface is pointing towards the rotation axis of the workpiece for convex areas of the workpiece, even surfaces in the border area can be processed leaving a minimal non-processable remainder.

An exact processing of the workpiece is ensured by determining the slope of the workpiece surface for each point on a section through the rotation axis of the workpiece, the section being parallel with the y-axis, furthermore identifying the location on the workpiece where the processing surface exhibits the same slope as said point and positioning the tool such that the point and the location coincide.

If the tool touches the workpiece also off the midplane of the processing surface depending on the control, a respective point can be processed using the optimal slope for touching the workpiece.

Controlling the grinding or polishing machine is very simple if the tool consists of a thin disk that exhibits the processing surface at its narrow side surface.

If a tool is used, that has the shape of a cone or a frustum, exhibiting the processing surface at its largest radius, processing the whole mechanically processable area of the workpiece is possible, too.

By orienting the tool in such a way that its side that has the largest radius is pointing towards the rotation axis of the workpiece, areas in the vicinity of the middle of the workpiece can be processed leaving a non-processable remainder.

Controlling the processing is simple by using CNC.

In the measuring method according to the invention, the caliper, with regard to its point of contact with the workpiece, is moved in exactly one plane that is parallel with the x-z plane and that is distanced from the rotation axis of the workpiece, the caliper having a constant y-value. Thus, the caliper is moved along a chord of the workpiece. This enables measuring in case of workpieces having central non-processable zones.

By calculationally converting the approached x-position to the related radius of the workpiece for each measuring point a virtual section through the diameter can be acquired.

The method according to the invention can be used even on aggressive surfaces if the surface, in particular a grinding surface, is provided with a uniformly thick layer before scanning it.

In general, rough surfaces that would damage a caliper can be provided with a uniformly thick layer before scanning them so that the caliper can be moved across them without getting damaged.

In all cases, known adhesive strips or adhesive films can be used which are available cost-effectively and simply.

The center of a rotationally symmetric workpiece can be identified independently of the specified shape of the workpiece by dividing the data acquired for determination of the center of the workpiece into two parts, mirroring the first part and subsequently determining the correlation of the mirrored and the unmirrored part und determining that location as actual center that gives the highest correlation value. An analytic representation of the course of the surface is not necessary. Thus, the method is insensitive to strong deviations from the specified shape as long as sufficient symmetry is present.

For measuring a turning chisel a sample piece is turned having piecewise linearly approximated sections instead of a continuous shape of a workpiece that is to be turned. The sections are created by means of the turning chisel, wherein, respectively, only a certain point of the cutting edge is engaging and a cone segment results. Also, a planar area of reference is turned onto the sample piece. Subsequently, the sample piece is measured and, by comparing the positions of the cone segments with the area of reference or by comparing the positions of the cone segments with each other, the position of the respective processing point of the cutting edge is determined as a sampling point of the shape of the cutting edge. Consequently, exact data about the course of the shape of turning chisels is available for the first time.

If the shape of the cutting edge is determined approximately from the acquired sampling points and resulting radii using interpolation one can perform exact turning using the measured turning chisel applying the collected data.

As an alternative solution, one can determine a mean cutting edge radius from the acquired sampling points for a simple calculation and handling.

At the grinding or polishing tool according to the invention, the processing surface is formed asymmetrically with regard to any mirror plane being normal to the tool's symmetry axis and the virtual center of the sphere is lying outside of the processing surface's midplane in relation to the thickness of the tool, the midplane being perpendicular to the symmetry axis of the tool. Thus, the highest point of the grinding or polishing disk is located nearer to one of the two borders of the disk. In case of convex workpieces, this border advantageously is the one that is pointing away from the rotation axis of the workpiece. In case of concave workpieces, this border advantageously is the one that is pointing towards the rotation axis of the workpiece. Therefore, the distance that has to be kept to a raised middle of the workpiece can be reduced. Thus, a larger area of the workpiece can be reached by processing.

If the virtual center of the sphere is lying at the outermost edge of the tool or outside of the tool, the grinding or polishing tool according to the invention possesses a steep cross section, where the highest point is located as far as possible at a border of the grinding or polishing disk. Thus, the least distance to the middle of the workpiece is reduced.

A grinding tool according to the invention can be made cost-efficiently with little effort if the processing surface's midplane in relation to the thickness of the tool, i.e. the center of the originally cylindrical grinding disk body, is offset from the rotation axis of the truing stone during truing.

By determining the area of the spherical surface section to be created on the basis of the slopes to be created on the workpieces to be processed by means of the tool and dependent on the grinding path, and positioning the tool off the rotation axis of the truing stone at the distance that has been determined between the sphere's center and the tool's midplane along the direction of the tool's symmetry axis while respecting the condition that the center of the virtual sphere is lying on the symmetry axis of the tool, it is ensured that the processing surface is always overlying parallel the surface to be processed, i.e. that the slope area of the workpiece defines the slope area of the grinding disk.

It is possible to create grinding tools according to the invention simply, fast and cost-efficiently in another way by arranging two cylindrical grinding disks against each other with or without distance in between them and truing both grinding disks in the same rotating way.

By using two grinding disks having identical dimensions, two grinding tools according to the invention can be made at once.

BRIEF DESCRIPTION OF THE DRAWINGS

In the following, the invention is described further using several embodiments and with reference to the drawings in which.

DETAILED DESCRIPTION

Figure 1:
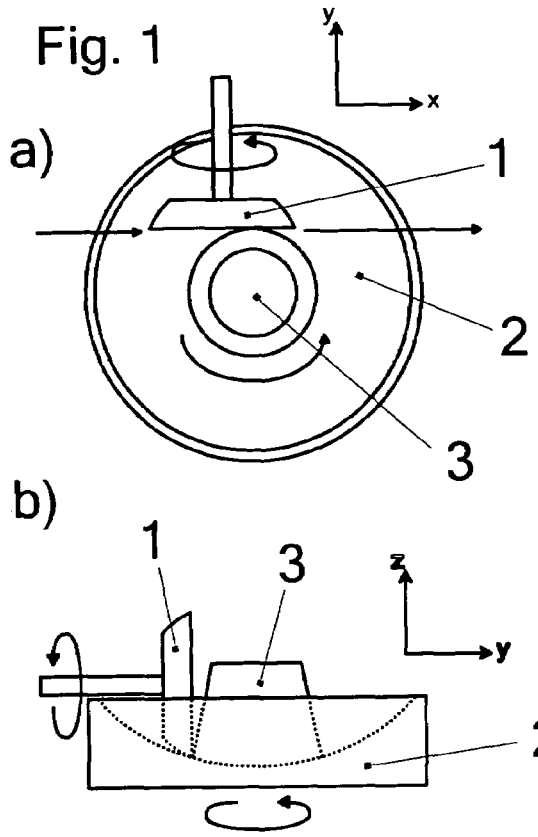
FIG. 1 shows a schematic representation of the processing method, where the grinding tool is moved along a chord and parallel with the x-axis.

Concerning the method shown schematically in FIG. 1, the top view of a tool 1 grinding a workpiece 2 is shown in FIG. 1*a* and the side view is shown in FIG. 1*b*. In each partial figure the coordinate system is drawn. The grinding tool 1 is running in the direction of the x-axis as generally known, but it is distanced from the center of the workpiece 2, around which a bump 3 is located. Thus, the movement is taking place along a chord of the workpiece 2.

Figure 2:
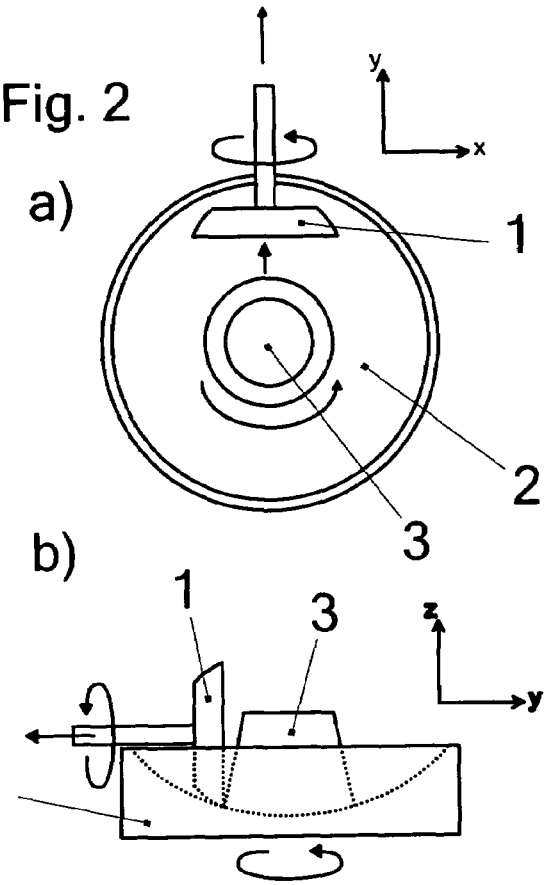
FIG. 2 shows a schematic representation of the processing method, where the grinding tool is moved radially and parallel with the y-axis.

Another method is shown by FIG. 2, once again as top view and as a side view, indicating also the coordinate system. The grinding tool 1 is running in y-direction and in z-direction along the surface of the workpiece 2 instead of running in x-direction and z-direction, wherein the workpiece exhibits a bump 3. The x-position is selected in such a way that the axes of workpiece and tool cross each other during the processing procedure. Therefore, the overlap of tool 1 and workpiece 2 is minimized within the radial direction.

Even though the known traditional grinding disks can be used in principal in both of these alternative methods they have the essential disadvantage of reaching very far to the center of the workpiece 2 because of their relatively flat shape. Thus, processing is possible only partially, i.e. outside of an area given by half of the thickness of the grinding disk.

Hence, a grinding tool 1 is used preferably at which the processing surface, i.e. the grinding surface, is a spherical surface section and has an asymmetric shape with regard to any mirror plane perpendicular to the symmetry axis. As the virtual sphere's center lies outside the midplane of the grinding surface the highest point of the grinding disk is lying nearer to one of the two borders of the grinding disk. Advantageously, this border is the one that is pointing towards the rotation axis of the workpiece 2 in case of concave workpieces 2 and it is the one that is pointing away from the rotation axis of the workpiece 2 in case of convex workpieces 2. That way, the distance to be kept from a raised middle of the workpiece 2 is reduced. Thus, a larger part of the workpiece 2 can be reached by processing.

So, when grinding a concave workpiece 2 along a chord or radially parallel with the y-axis, the highest point on that side that is pointing towards the center of the workpiece 2 should be located behind said center if viewed in y-direction. The objective is that the processing surface always overlies parallel the surface to be processed. Thus, the slope of the workpiece 2 defines the necessary slope of the grinding tool 1. For example, if a mirror to be produced possesses a radial slope from 10° to 30°, the grinding disk's cross section must also exhibit a slope from 10° to 30°. The exact position of the virtual center and also the necessary or permitted thickness, respectively, of the disk body always depend on the shape of the workpiece 2. More precisely, they depend on the required slopes as mentioned above. Exactly as in traditional grinding, the surface curvature of the virtual sphere has to be stronger than the strongest curvature of the workpiece 2 in case of concave surfaces.

Similar conditions result when using toroid shaped grinding tools 1. Again, the toroid's center has to be displaced to obtain the desired slopes.

Alternatively, a cone or a frustum having a grinding surface on its jacket at its largest radius can be used. In this case, it is basically possible to orient the largest radius towards the rotation axis of the workpiece 2 or away from it. The first option is used preferably for concave and convex workpieces 2.

Another alternative way is to use a highly narrow disk similar to a cut-off wheel, where only one edge is drawn on for processing. In the same way the large radius of a cone or a frustum can be used.

In the case of a cut-off wheel, the cross section of the cut-off wheel is abstracted to a point for controlling the processing. From there, a simple calculation results for the CNC program. For each of the points on the radius of workpiece 2 along y-direction or on the chord of the workpiece 2, respectively, the disk has to be positioned vertically above it.

The control is more complicated when using a spherical surface section as grinding surface. In the case of processing parallel with the y-axis, the slope has to be calculated for each point on the radial section of the workpiece 2. Then, the point that has the same slope on the grinding tool 1 has to be acquired and the grinding tool 1 has to be positioned in such a way that both points coincide. Even though, in case of grinding along a chord, the grinding tool 1 runs on a chord parallel with the x-axis having a constant y-value the point of contact moves in y-direction thereby. For each x-position it has therefore to be determined at which y-coordinate the processing surface, i.e. the grinding surface, is going to touch the workpiece 2 first if the workpiece 2 is driven into the tool 1. Then, the appropriate z-position at this x-position has to be approached by the CNC program.

It is understood that the methods according to the invention can be used in analog ways on machines with differently assigned coordinate systems.

Besides, they are applicable in the same way for workpieces consisting of metal or other materials as semiconductors.

Similar as for grinding, the same methods can be applied to polishing if the grinding tool 1 is logically replaced by a polishing tool.

Figure 3:
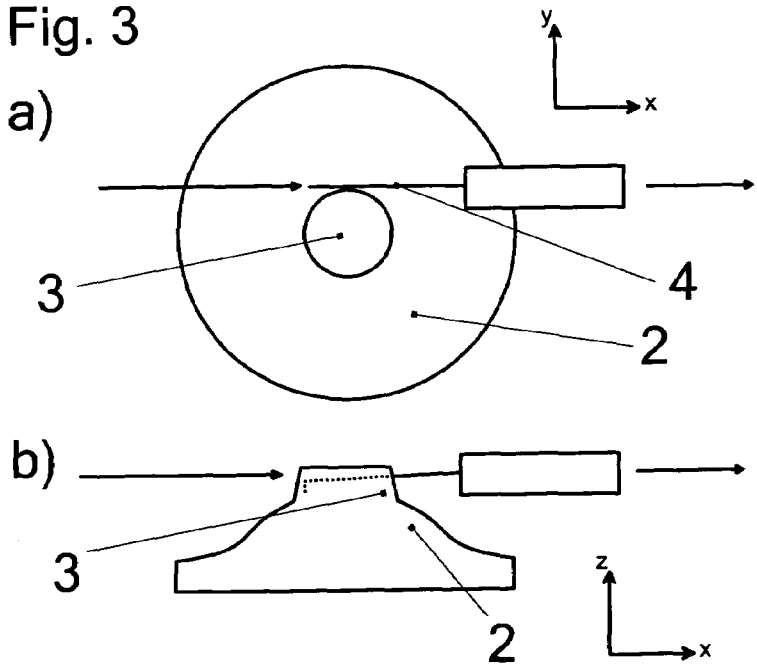
FIG. 3 shows a schematic representation of the measuring method.

FIG. 3 schematically shows a method for measuring rotationally symmetric workpieces 2. A path across a chord of the workpiece 2 is selected, so the measuring system comprising a caliper 4 is drawn on a line that is distanced from the center of the workpiece 2 and parallel with the x-axis, the measuring system having a constant y-value. That way, the bump 3 is not touched by it.

For each measuring point, the approached x-position must be calculationally converted to the corresponding radius in order to reobtain a section along the diameter, which is virtual then.

By tactile measuring, the grinding tools 1 themselves and other rough bodies can be measured. In order to avoid damage to the caliper, a layer of uniform thickness on which the caliper is applicable is applied onto the grinding surface or other rough surfaces. Particularly, a layer in form of adhesive stripes or films can be used.

For grinding off the section through a workpiece 2, where the section is parallel with the x-axis, a rather steep cross section of the disk is desirable instead of a traditional grinding disk where the highest point is located exactly in the midplane across the symmetry axis of the disk. In the case of a rather steep cross section, the highest point is located as far as possible at the border of the disk. For grinding a concave workpiece along a chord or radially parallel with the y-axis, the highest point should thus be located on that side of the disk that is turned towards the center of the workpiece 2 if the disk is located behind said center when viewed in y-direction. The objective is that the processing surface always overlies parallel the surface to be processed. Thus, the slope of the workpiece 2 defines the necessary slope of the grinding tool 1. For example, if a mirror to be produced possesses a radial slope from 10° to 30° the grinding disk's cross section must also exhibit a slope from 10° to 30°.

Figure 4:
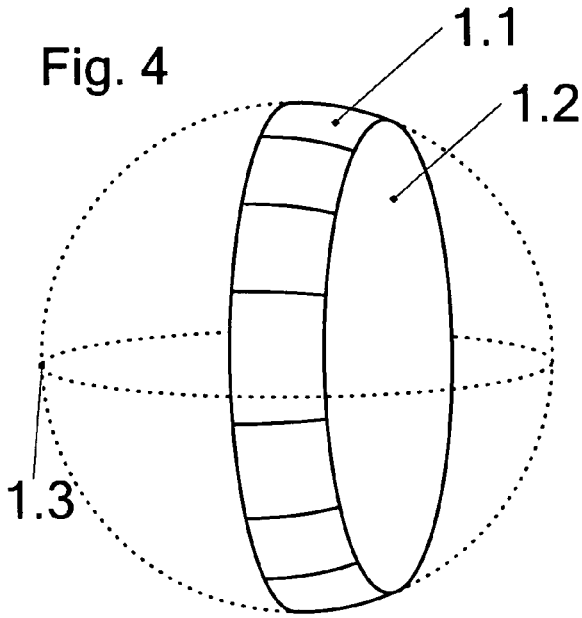
FIG. 4 shows a perspective view of a grinding tool according to the invention.

For this purpose, a grinding tool 1 is used as depicted for example in FIG. 4 within an envelope of a virtual sphere 1.3 whose center lies in the middle of one of the two side surfaces 1.2 of the grinding tool 1. It is a grinding disk which has been formed to the shape according to the invention. The spindle by which the tool 1 is rotated can be located on both sides of the disk, alternatively, depending on if convex or concave workpieces 2 or parts of workpieces 2 are about to be processed.

In this case, the processing surface 1.1, i.e. the grinding surface, is a spherical surface segment forming the boundary of the grinding tool 1 and representing a section from the virtual sphere 1.3. The virtual center of the sphere 1.3 lies outside of the disk's midplane with regard to its thickness so that the disk is shaped asymmetrically. The center can even lie outside of the disk body.

The exact position of the virtual center and the necessary or permitted thickness, respectively, of the disk body depend on the shape of the workpiece 2. More precisely, they depend on the required slopes as mentioned above. Exactly as in traditional grinding, the surface curvature of the virtual sphere 1.3 has to be stronger than the strongest curvature of the workpiece 2 in case of concave surfaces.

For polishing off the section through a workpiece 2, the section being parallel with the x-axis, a polishing tool of the same shape can be used similarly.

Figure 5:
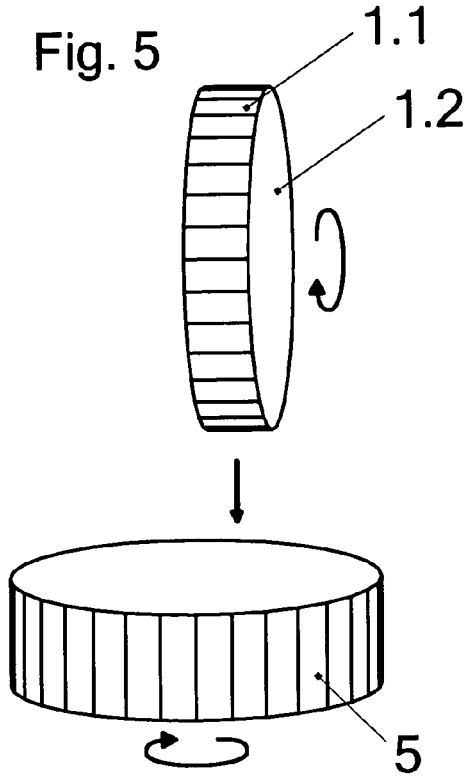
FIG. 5 shows the creation of a grinding tool.

In FIG. 5, the production of the shape of a grinding tool 1 is depicted schematically. The cylindrical grinding disk 1 that exhibits the grinding surface 1.1 on its cylinder barrel surface is rotating around its symmetry axis and is driven into the truing stone 5. In doing so, the grinding disk 1 is positioned at a distance from the rotation axis of the truing stone 5 in direction of the symmetry axis of the grinding tool 1 with regard to the disk's center or its midplane across its symmetry axis. In other words, within the coordinate system of a grinding machine the grinding tool 1 is distanced from the rotation axis of the truing stone 5 in y-direction.

Figure 6:
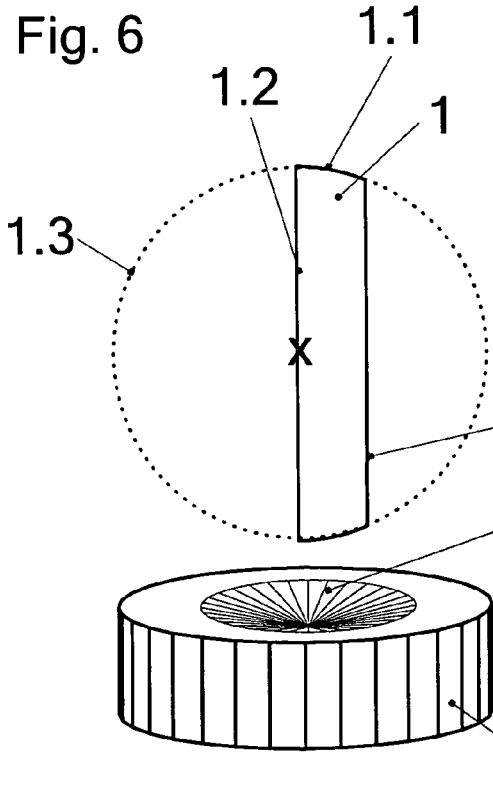
FIG. 6 shows a section through the final tool.

In FIG. 6, the result of this procedure is clarified. The truing stone 5 obtains a ball-shaped cavity as in traditional truing. However, the grinding disk receives the shape of a non-centrical spherical section. The grinding surface 1.1 thus receives the shape of a spherical surface segment.

Figure 7:
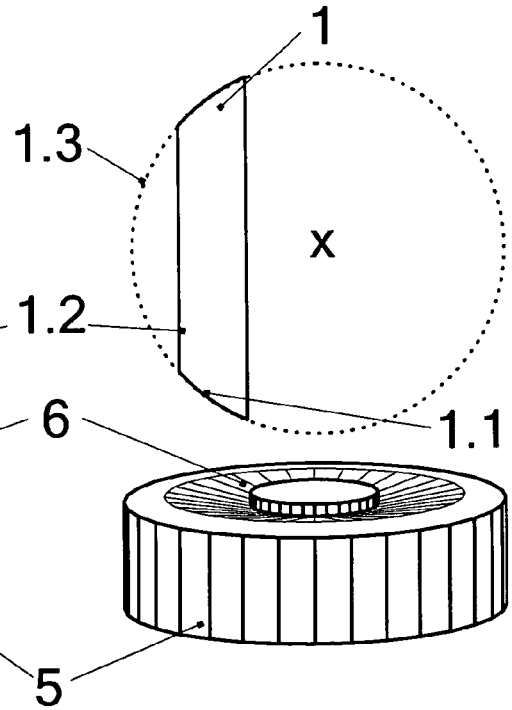
FIG. 7 shows a section through another example of a final tool.

The distance between the center of the disk 1 and the rotation axis of the truing stone 5 can be selected that large that the grinding disk 1 does not touch the rotation axis of the truing stone 5 at all. The truing stone 5 then exhibits an untouched area in the middle as shown in FIG. 7. Here, the steepest slope on the grinding surface 1.1 is steeper than in the example of FIG. 6.

The necessary area of the spherical section is calculated on the basis of the desired slopes and depending on the grinding path of the tool 1. The disk 1 is shifted parallel with the y-axis as far as the distance calculated between the virtual sphere's center and the grinding disk's center, respecting the condition that the center of the virtual sphere is lying on the elongation of the symmetry axis of the disk 1.

Using this procedure, the spherical section shaped grinding tool 1 according to the invention is manufactured from the cylindrical grinding disk.

Figure 8:
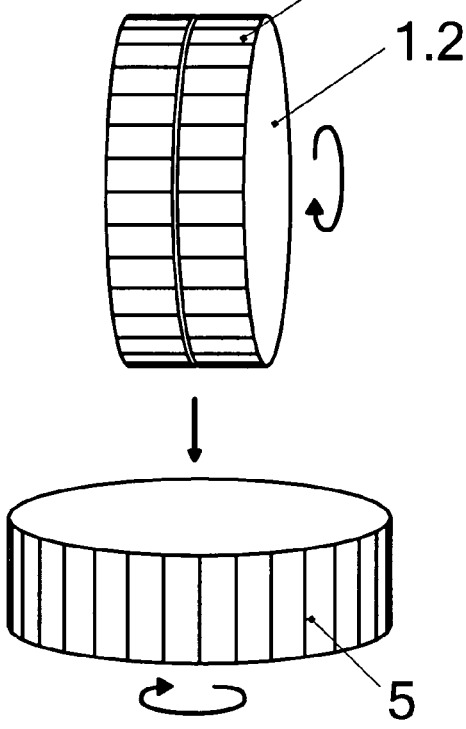
FIG. 8 shows an alternative method for making a tool.

FIG. 8 shows another possible procedure. Here, two identical grinding disks are arranged beneath each other. Preferably, they are pressed together. They are driven centrically into the truing stone 5.

Figure 9:
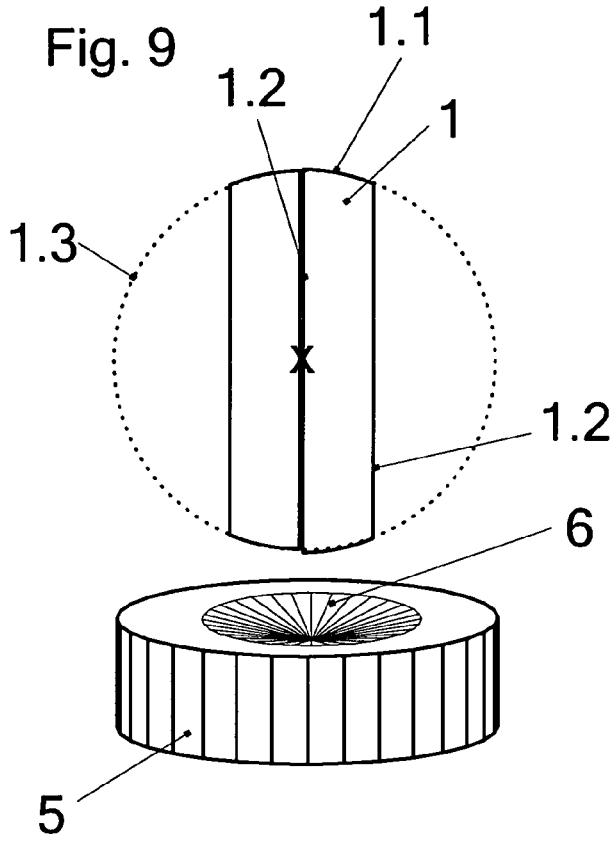
FIG. 9 shows a tool made using the method shown in FIG. 8.

As indicated in FIG. 9, a cavity results in the truing stone 5 again while the grinding tools 1 created this way exhibit asymmetric grinding surfaces 1.1 in relation to any plane being perpendicular to the rotation and symmetry axis of the tool 1.

Figure 10:
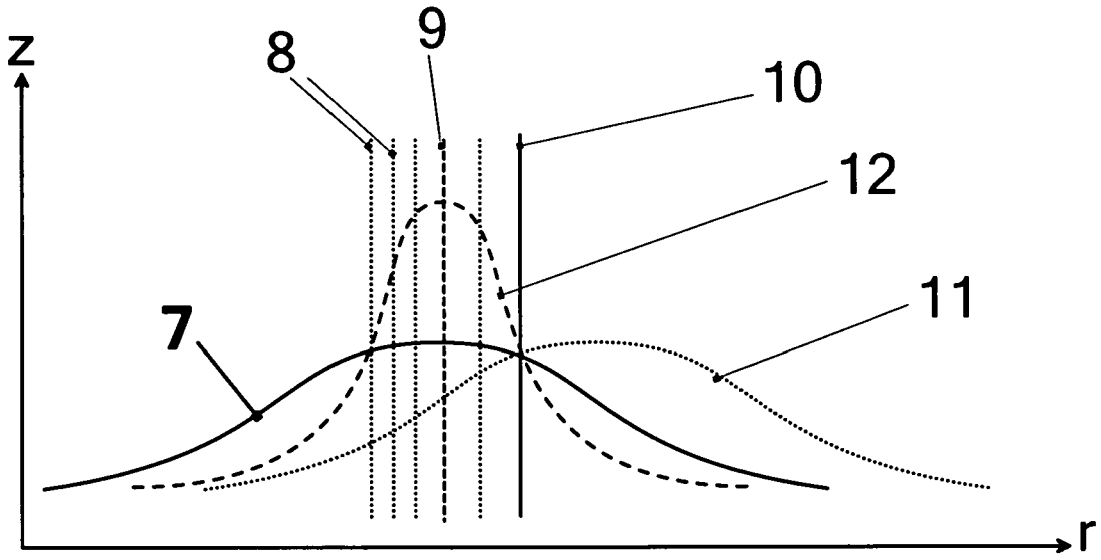
FIG. 10 shows a schematic representation of the method for determining the center of the workpiece.

The method depicted in FIG. 10 serves for identifying the center or the symmetry axis of rotationally symmetric workpieces 2, respectively. The measuring data of the profile 7 are divided into two parts successively at all potential positions 8 of the center or of the symmetry axis, respectively, and mirrored about the respective position 8. In the depicted example they are mirrored about position 10. Then, the correlation of the mirrored parts 11 and the original parts 7 is determined, i.e. the scalar product of both of them is divided by the product of the norm of the respective parts. This value is maximal if the mirroring position 10 coincides with the actual center 9. In the depicted example, curve 12 shows the course of the correlation depending on the selected axis.

Figure 11:
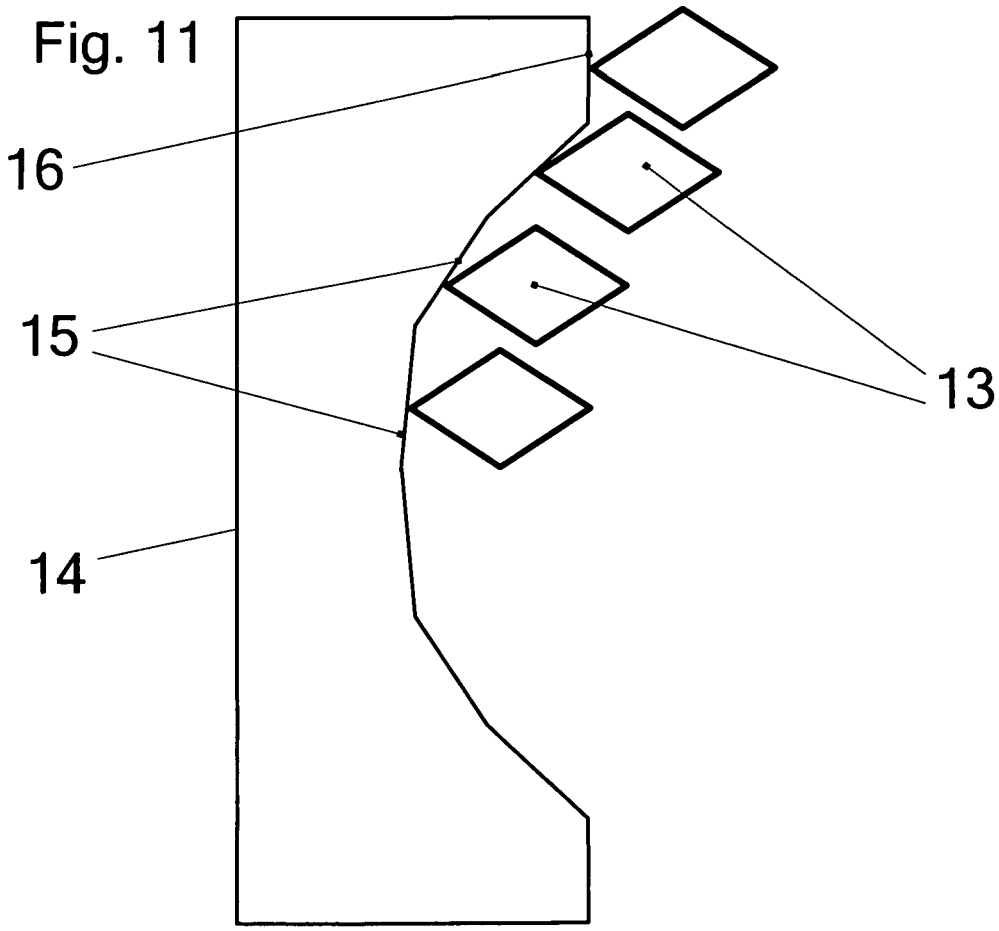
FIG. 11 shows a schematic representation of the method for measuring turning chisels.

FIG. 11 illustrates a method for identifying the shape of a cutting edge of a cutting insert 13. A sample piece 14 is turned, where the continuous shape of the workpiece is replaced by a piecewise linear approximation. For example, an asphere becomes a string of cone segments 15. Within a cone segment 15 only a certain point of the cutting edge is engaged depending on the slant of the cone. Additionally, in the same step a planar area of reference 16 is turned onto the sample piece 14. Subsequently, the sample piece 14 is measured and the exact position of the processing point of the cutting edge can be identified as a sample point for the shape of the cutting edge by comparing the positions of the cone segments 15 with the area of reference 16 or with each other.

From these sample points, i.e. one per cone segment 15, the shape of the cutting edge can be determined by interpolating. The CNC program can then be adapted appropriately. Alternatively, a mean cutting edge radius can be determined from the identified sample points.

What is claimed is:

1. A method for processing a rotationally symmetric workpiece in a space defined by orthogonal x-, y- and z-axes, the workpiece having a symmetry axis parallel to the z-axis, the method comprising:

rotating the workpiece around the symmetry axis;

moving the workpiece parallel to the z-axis;

providing a rotating, rotationally symmetric tool having a processing surface and a rotation axis parallel with the y-axis;

moving the tool in a plane parallel to a plane defined by the x- and z-axes and at a constant distance in the y-direction from the workpiece symmetry axis, the processing surface of the tool thereby contacting a surface of the workpiece.

2. The method as recited in claim 1, wherein the workpiece includes at least one optically effective surface.

3. The method as recited in claim 1, wherein the tool is one of a grinding tool and a polishing tool.

4. The method as recited in claim 1, further comprising determining, for each x-position of the tool, a y-position at which the processing surface will contact the surface of workpiece and moving the workpiece in the z-direction accordingly.

5. The method as recited in claim 1, wherein the processing surface includes a rotationally symmetric spherical surface section of a virtual sphere, a center of the virtual sphere on the rotation axis of the tool, the spherical surface section being formed asymmetrically relative to a mirror plane disposed normal to the rotation axis and the virtual center is lying outside of a midplane of the processing surface.

6. The method as recited in claim 1, wherein the tool includes a shape of a toroid section disposed perpendicularly to the symmetry axis.

7. The method as recited in claim 1, wherein the tool includes a shape of a thin disk, and wherein the processing surface is a narrow side surface of the thin disk.

8. The method as recited in claim 1, wherein the tool includes a shape of one of a cone and a frustum, and wherein the processing surface at a largest radius.

9. The method as recited in claim 1, further comprising:

providing a caliper moveable parallel with the x-axis and capable of contacting the surface of the workpiece at a point of contact and to measure z-values of the surface; and moving the caliper in a plane parallel to the x-z plane and at a constant distance in the y-direction from the symmetry axis.

10. The method as recited in claim 9, wherein the moving is performed so as to at least one of acquire a cutting profile and determine a center of the workpiece.

11. The method as recited in claim 10, further comprising calculationally converting an x-position of each point of contact to a related radius of the workpiece.

12. The method according to claim 1, wherein the workpiece has a rough surface and further comprising:

applying a uniformly thick layer onto the rough surface; and scanning the surface using a caliper.

13. The method as recited in claim 12, wherein the workpiece is rotationally symmetric and wherein the scanning is a tactile scanning.

14. The method as recited in claim 13, wherein the layer is at least one of an adhesive strip or an adhesive film.

15. A method for processing a rotationally symmetric workpiece in a space defined by orthogonal x-, y-, and z-axes, the workpiece having a symmetry axis parallel to the z-axis, the method comprising:

rotating the workpiece around the symmetry axis;

moving the workpiece parallel to the z-axis;

providing a rotating, rotationally symmetric tool having a processing surface and a rotation axis parallel with the y-axis;

moving the tool in a plane parallel to a plane defined by the y- and z-axes and intersecting the workpiece symmetry axis, the processing surface of the tool thereby contacting a surface of the workpiece.

* * * * *